US008029967B2

(12) United States Patent
Kawamura et al.

(10) Patent No.: US 8,029,967 B2
(45) Date of Patent: Oct. 4, 2011

(54) METHOD FOR PRODUCING TONER

(75) Inventors: Masateru Kawamura, Toyoake (JP); Jun Ikami, Nagoya (JP); Takanori Uno, Nagoya (JP); Tomoaki Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 435 days.

(21) Appl. No.: 12/357,932

(22) Filed: Jan. 22, 2009

(65) Prior Publication Data

US 2009/0191477 A1 Jul. 30, 2009

(30) Foreign Application Priority Data

Jan. 24, 2008 (JP) ..... 2008-014179

(51) Int. Cl.
*G03G 9/08* (2006.01)

(52) U.S. Cl. ..... 430/137.14; 430/137.1

(58) Field of Classification Search ..... 430/137.1, 430/137.14
See application file for complete search history.

(56) References Cited

U.S. PATENT DOCUMENTS

| | | | | |
|---|---|---|---|---|
| 2003/0027066 | A1 | 2/2003 | Yamashita et al. | |
| 2003/0054280 | A1* | 3/2003 | Ishihara et al. | 430/124 |
| 2007/0059618 | A1* | 3/2007 | Kurimoto et al. | 430/58.5 |

FOREIGN PATENT DOCUMENTS

| | | |
|---|---|---|
| JP | 07-152202 | 6/1995 |
| JP | 09-015902 | 1/1997 |
| JP | 10-153877 | 6/1998 |
| JP | 11-015191 | 1/1999 |
| JP | 2002-296839 | 10/2002 |
| JP | 2004-109571 | 4/2004 |
| JP | 2005-122073 | 5/2005 |
| JP | 2006-178407 | 7/2006 |
| JP | 2006-184791 | 7/2006 |
| JP | 2006-258828 | 9/2006 |
| JP | 2007-072327 | 3/2007 |

* cited by examiner

*Primary Examiner* — Hoa Le
(74) *Attorney, Agent, or Firm* — Banner & Witcoff, Ltd.

(57) ABSTRACT

Provided is a method for producing a toner including the steps of: preparing a resin liquid by mixing at least a binder resin made of polyester resin and a colorant with an ester organic solvent represented by the following general formula (1); dispersing the resin liquid in an aqueous medium to form an emulsion; and removing the ester organic solvent from the emulsion to produce a toner, in which the ester organic solvent before the preparation of the resin liquid contains water in an amount of not less than 1% by weight and up to the saturation solubility at 25° C. to the ester organic solvent:

[Chem. 1]

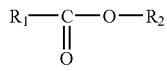

(1)

(in which R1 is a hydrogen atom or a methyl group, and R2 is an alkyl group having 1 to 4 carbon atoms).

5 Claims, No Drawings

METHOD FOR PRODUCING TONER

CROSS REFERENCE TO RELATED APPLICATION

This application claims priority to Japanese Patent Application No. 2008-014179 filed on Jan. 24, 2008, the disclosure of which is hereby incorporated into the present application by reference.

TECHNICAL FIELD

The present invention relates to a method for producing a toner which is employed in electrophotography, electrostatic recording, and other imaging techniques.

BACKGROUND

As a method for producing a toner, there has been known a dissolution/suspension method of obtaining toner particles by mixing an oil phase containing a resin, a colorant, and an organic solvent, and an aqueous phase, and then removing the organic solvent from the mixture.

For example, the following five methods of obtaining toner particles have been proposed. A first method includes granulating a liquid having a polyester resin and a colorant dissolved or dispersed in a solvent, in an aqueous medium containing an inorganic dispersing agent, and then removing the solvent therefrom.

A second method includes mixing a binder resin and a colorant in an organic solvent, dispersing the resulting mixture in an aqueous medium containing a dispersion aid, removing the organic solvent from the resulting dispersion, and thereafter subjecting the dispersion to an acid-alkali treatment.

A third method includes mixing a coloring resin and a colorant in a solvent, dispersing the resulting composition in an aqueous medium in the presence of a hydrophilic inorganic dispersing agent, and removing the solvent from the resulting suspension.

A fourth method includes dissolving or dispersing a binder resin and a colorant in a solvent, dispersing the resulting composition mixing solution in an aqueous medium to prepare a suspension, adding a thickener in the resulting suspension, and thereafter removing the solvent from the suspension.

A fifth method includes dissolving and/or dispersing a binder resin and a colorant in an organic solvent having solubility to water to form an oil phase, mixing the oil phase and an aqueous phase with stirring to form a mixture, adding an emulsifier (neutralizing agent) thereto to form an emulsion, and removing the organic solvent from the emulsion.

SUMMARY

However, in the first to third methods, an organic solvent having relatively low hydrophilicity such as toluene or ethyl acetate is used and an inorganic dispersing agent is also used as a dispersing agent. Therefore, after the removal of the solvent, toners obtained by those methods are prone to have irregularities on their particle surfaces although their shapes are generally spherical. In the dissolution/suspension method, when the organic solvent is removed from the emulsion droplets, the liquid droplets are shrunk in volume. At such time, the inorganic dispersing agent, however, hinders uniform shrinkage in volume, which in turn is believed to cause the above problem.

To solve this problem, in the fourth method, addition of a thickener is proposed in order to control the shape of the toner. This method, however, requires a large amount of wash water to remove the thickener adhered to the toner surface.

On the other hand, in the fifth method, without using any inorganic dispersing agent, the binder resin having a polar group is neutralized to impart hydrophilicity to the resin itself, so that the resulting emulsion is stable. In this method, the lack of an inorganic dispersing agent enables production of toner particles having a spherical form with smooth surfaces.

However, since this method employs an organic solvent having relatively high hydrophilicity such as methyl ethyl ketone or tetrahydrofuran, the resin is easily neutralized but a void is easily produced in the inner portion of the toner particle by removing the organic solvent, so that the mechanical strength of the toner particle decreases. Such toner is easily crushed during triboelectric charging with a layer thickness regulating blade or during agitation in a developer, in a non-magnetic single-component developing method in which a relatively high stress is applied during development, and as printing progresses, the crushed fine particles increase, whereby printing failure such as fog is liable to occur. Further, since the organic solvent has a high affinity for water, an abrupt phase change may occur during emulsification, so that segregation of the resin or the colorant occurs, which may adversely affect the printing characteristics of the toner.

It is an object of the present invention to provide a method for producing a toner, capable of preventing poor dispersion of a colorant and precipitation of a resin dissolved in a resin solution, improving toner characteristics, and also producing a spherical-shaped toner with a smooth surface, by a simple method.

According to one aspect of the present invention, there is provided a method for producing a toner including the steps of preparing a resin liquid by mixing at least a binder resin made of polyester resin and a colorant with an ester organic solvent represented by the following general formula (1); dispersing the resin liquid in an aqueous medium to form an emulsion; and removing the ester organic solvent from the emulsion to produce a toner, in which the ester organic solvent before the preparation of the resin liquid contains water in an amount of not less than 1% by weight and up to the saturation solubility at 25° C. to the ester organic solvent.

[Chem. 1]

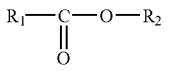

(1)

(in which R1 is a hydrogen atom or a methyl group, and R2 is an alkyl group having 1 to 4 carbon atoms).

DETAILED DESCRIPTION

In the following, one embodiment of the method for producing the toner of the present invention will be explained.

1) Step of Preparing an Oil Medium

In this method, first, water in an amount of not less than 1% by weight and up to the saturation solubility at 25° C. to an ester organic solvent is mixed with the ester organic solvent to prepare an oil medium.

(Ester Organic Solvent)

The ester organic solvent is represented by the following general formula (1):

[Chem. 3]

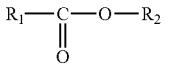

(1)

(in which R1 is a hydrogen atom or a methyl group, and R2 is an alkyl group having 1 to 4 carbon atoms).

Examples of the alkyl group having 1 to 4 carbon atoms represented by R2 include a methyl group, an ethyl group, n-propyl group, an isopropyl group, an n-butyl group, an isobutyl group, a sec-butyl group, and a tert-butyl group.

Examples of the ester organic solvent represented by the general formula (1) include methyl formate, ethyl formate (water solubility at 25° C.: 17% by weight), n-propyl formate, isopropyl formate, n-butyl formate, isobutyl formate, sec-butyl formate, tert-butyl formate, methyl acetate (water solubility at 25° C.: 8% by weight), ethyl acetate (water solubility at 25° C.: 2.94% by weight), n-propyl acetate (water solubility at 25° C.: 2.9% by weight), isopropyl acetate (water solubility at 25° C.: 1.8% by weight), n-butyl acetate (water solubility at 25° C.: 1.86% by weight), isobutyl acetate (water solubility at 25° C.: 1.64% by weight), sec-butyl acetate (water solubility at 25° C.: 1.65% by weight), and tert-butyl acetate, and ethyl acetate is preferable.

(Preparation of Oil Medium)

For preparation of the oil medium, for example, water in an amount of not less than 1% by weight, or preferably not less than 1.2% by weight, and up to the saturation solubility at 25° C. to an ester organic solvent, or preferably not more than 2.9% by weight, is mixed with the ester organic solvent and then blended together. Thus, an oil medium is prepared as a homogeneous solution.

When the amount of water is less than this range, an abrupt phase change may not be able to be suppressed in the step of preparing an emulsion. On the contrary, when the amount of water exceeds the saturation solubility, a phase separation between the oil medium and water may occur.

2) Step of Preparing a Resin Liquid

Next, in this method, at least, a binder resin made of polyester resin, a colorant, if necessary a wax and a charge-controlling agent are mixed with the oil medium described above to prepare a resin liquid.

(Binder Resin)

The binder resin is a predominant component of the toner and is made of a synthetic resin which fixes (heat-seals) on a surface of a recording medium (e.g., paper sheet or OHP sheet) through heating and/or pressure application. According to the present invention, such binder resin is made of polyester resin.

It is preferable that the binder resin made of polyester resin has a hydrophilic group. Examples of the hydrophilic group include anionic groups such as a carboxyl group and a sulfonic acid group.

A polyester resin having an anionic group is preferable, and a polyester resin having a carboxyl group (polyester resin having an acid value) is more preferable.

The polyester resin having a carboxyl group described above is commercially available, and for example, a polyester resin having an acid value of 0.5 to 40 mg KOH/g, or preferably 1.0 to 20 mg KOH/g; a weight-average molecular weight (determined by GPC using a calibration curve of standard polystyrene) of 9,000 to 200,000, or preferably 20,000 to 150,000; a crosslinked fraction (THF insoluble fraction) of 10% by weight or less, or preferably 0.5 to 10% by weight; and a glass transition point (Tg) of 50 to 70° C., or preferably 55 to 65° C., is used.

When the acid value is lower than this range, the amount of the carboxyl group that reacts with a neutralizing agent to be described later is low, so that the resulting emulsion becomes unstable, which may fail to obtain a stable slurry. On the contrary, when the acid value is higher than this range, the hygroscopicity of the toner increases, which may cause printing failure under a high temperature environment.

When the weight-average molecular weight is lower than this range, the mechanical strength of the toner becomes insufficient, so that the toner particles may be easily crushed. On the contrary, when the weight-average molecular weight is higher than this range, the viscosity of the resin liquid becomes excessively high, so that emulsion droplets of the emulsion to be described later becomes larger, which may tend to generate coarse toner particles.

Although crosslinked fraction may be unnecessary, when 0.5% by weight or more of the crosslinked fraction exists, the mechanical strength and the fixation (in particular, offset on the higher temperature side) of the toner particles can be improved, which is preferable. However, when 10% by weight or more of the crosslinked fraction exists, the droplet size of the emulsion increases, which may tend to generate coarse toner particles.

(Colorant)

The colorant imparts a desired color to the toner, and is dispersed or permeated into the binder resin. Examples of the colorant include carbon black; organic pigments such as Quinophthalone Yellow, Hansa Yellow, Isoindolinone Yellow, Benzidine Yellow, Perynone Orange, Perynone Red, Perylene Maroon, Rhodamine 6G Lake, Quinacridone Red, Rose Bengal, Copper Phthalocyanine Blue, Copper Phthalocyanine Green and a diketopyrrolopyrrole pigment; inorganic pigments or metal powders such as Titanium White, Titanium Yellow, ultramarine blue, Cobalt Blue, red iron oxide, aluminum powder and bronze; oil-soluble dyes or dispersion dyes such as azo dyes, Quinophthalone dyes, anthraquinone dyes, xanthene dyes, triphenylmethane dyes, Phthalocyanine dyes, indophenol dyes and indoaniline dyes; and rosin dyes such as rosin, rosin-modified phenol and rosin-modified maleic acid resin. Further, other dyes and pigments treated with higher fatty acid or resin may be used.

These can be used alone or in combination corresponding to a desired color. For example, when a mono-chromatic color toner is provided, the colorant can be prepared by mixing a pigment and a dye of the same color; for example, rhodamine pigment and dye, Quinophthalone pigment and dye, or Phthalocyanine pigment and dye.

(Wax)

The wax is added as required in order to improve fixation of the toner to a recording medium. In the case of a thermal pressure fixing system, it is common to include wax in the inner portion of the toner so as to facilitate peeling of the toner from a heating medium. Examples of the wax include ester waxes and hydrocarbon waxes.

Examples of the ester wax include aliphatic ester compounds such as stearate and palmitate; and polyfunctional ester compounds such as pentaerythritol tetramyristate, pentaerythritol tetrapalmitate and dipentaerythritol hexapalmitate.

Examples of the hydrocarbon wax include polyolefine waxes such as low-molecular weight polyethylene, low-molecular weight polypropylene and low-molecular weight polybutylene; plant-derived natural waxes such as candelilla wax, carnauba wax, rice wax, Japan wax and Jojoba wax;

petroleum waxes and modified waxes thereof such as paraffin, microcrystalline and petrolatum; and synthetic waxes such as Fischer-Tropsch wax.

These waxes can be used alone or in combination. Among the above waxes, a wax having a melting point of 50 to 100° C. is preferable. Even when a fuser has a low heating temperature, a wax having a low melting point and a low melt viscosity melts before the binder resin melts and then exude from the surface of the toner, which can prevent offset. More specific examples of the wax include ester waxes and paraffin waxes.

(Charge-Controlling Agent)

The charge-controlling agent can be added as required. A known charge-controlling agent can be used, and examples of the positively chargeable charge-controlling agent include nigrosine dye, quaternary ammonium compound and basic group-containing compound; and other compounds such as tertiary amino group-containing acrylic resin and polymer compounds having a functional group such as quaternary ammonium salt. Examples of the negatively chargeable charge-controlling agent include trimethyl ethane dyes, azo dyes, copper phthalocyanine, metal salicylate complex, metal benzilate complex, Perylene, Quinacridone and metal complex azo dyes.

(Preparation of Resin Liquid)

The resin liquid is prepared in the form of a solution or a dispersion by mixing a binder resin made of polyester resin, a colorant, if necessary a wax and a charge-controlling agent, with an oil medium.

For preparation of the resin liquid, for example, the binder resin made of polyester resin, the colorant, if necessary the wax and the charge-controlling agent are mixed with the oil medium so that the amount of the binder resin is in the range of 5 to 40 parts by weight, or preferably 10 to 30 parts by weight, the amount of the colorant is in the range of 0.25 to 3 parts by weight, or preferably 0.5 to 2 parts by weight, if necessary, the amount of the wax is in the range of 0.25 to 4 parts by weight, or preferably 0.5 to 3 parts by weight, and if necessary, the amount of the charge-controlling agent is in the range of 0.01 to 4 parts by weight, or preferably 0.05 to 3 parts by weight, per 100 parts by weight of the oil medium, and the mixture is then blended together.

When the resin liquid contains the wax, the wax is dissolved in the ester organic solvent by mixing and blending each of the components together, and then heating the mixture at a heating temperature capable of dissolving the wax or more and less than the boiling point of the ester organic solvent, specifically, although the temperature depends on the type of wax or ester organic solvent, for example, at a temperature exceeding 30° C., or preferably from 32 to 70° C.

When a wax which does not dissolve in an ester solvent is used, the wax is preliminarily formed into smaller particles than those of the binder resin to prepare wax microparticles, and the wax microparticles are added to the resin liquid and mixed together. As the method of finely pulverizing the wax, a known method is used and includes, for example, a method of mechanically pulverizing a wax in vapor phase with a grinder used for producing pulverized toners, and further, a method including mixing a wax in a solvent and mechanically crushing the wax in liquid phase with a high-pressure homogenizer with heating as required. In this case, it is preferable to use the same solvent as the ester organic solvent used for the resin liquid.

The colorant can be mixed with the resin liquid by preliminarily dispersing the colorant in the ester organic solvent to prepare a colorant dispersion, and then mixing the colorant dispersion with the oil medium. In this preparation, in order to disperse the colorant, a dispersing agent or a binder resin in place of the dispersing agent, can be added. Preferably, a binder resin is added.

For preparation of the colorant dispersion, for example, the colorant, the binder resin made of polyester resin and the ester organic solvent are mixed so that the amount of the binder resin is in the range of 50 to 200 parts by weight, or preferably 80 to 150 parts by weight, and the amount of the ester organic solvent is in the range of 300 to 1000 parts by weight, or preferably 300 to 900 parts by weight, per 100 parts by weight of the colorant, the mixture is preliminarily dispersed with an agitator (e.g., a disper and a homogenizer), and the dispersion is then finely dispersed with a dispersing apparatus (e.g., a beads mill and a high-pressure homogenizer).

3) Step of Preparing an Emulsion

Next, in this method, an aqueous medium and the resin liquid are mixed to prepare an emulsion.

(Aqueous Medium)

The aqueous medium is water or an aqueous medium containing water serving as a predominant component in which a neutralizing agent or a dispersion stabilizing aid is mixed. In the present invention, a polar group (preferably a carboxyl group) in a polyester resin is allowed to react with a neutralizing agent to be neutralized, so that the hydrophilicity of the resin itself is improved, thereby emulsifying the resin in water and stabilizing the emulsion. As the neutralizing agent, for example, an alkaline aqueous solution such as aqueous ammonia, sodium hydroxide, and potassium hydroxide, or an amine solvent is used, and an amine solvent is preferably used.

As the amine solvent, a primary alkyl amine having an alkyl group of 2 to 4 carbon atoms, and a secondary alkyl amine having an alkyl group of 1 to 4 carbon atoms can be used. The alkyl groups of the secondary alkyl amines having an alkyl group of 1 to 4 carbon atoms may be the same or different from each other.

Examples of the primary alkyl amine having an alkyl group of 2 to 4 carbon atoms include ethyl amine, n-propylamine, isopropylamine, n-butylamine, isobutylamine, sec-butylamine, and tert-butylamine.

Examples of the secondary alkyl amine having an alkyl group of 1 to 4 carbon atoms include dimethylamine, methylethylamine, methyl-n-propylamine, methyl-isopropylamine, methyl-n-butylamine, methyl-isobutylamine, methyl-sec-butylamine, methyl-tert-butylamine, diethylamine, ethyl-n-propylamine, ethyl-isopropylamine, ethyl-n-butylamine, ethyl-isobutylamine, ethyl-sec-butylamine, ethyl-tert-butylamine, di-n-propylamine, n-propylisopropylamine, n-propyl n-butylamine, n-propylisobutylamine, n-propyl-sec-butylamine, n-propyl-tert-butylamine, diisopropylamine, isopropyl-n-butylamine, isopropyl-isobutylamine, isopropyl-sec-butylamine, isopropyl-tert-butylamine, di-n-butylamine, n-butyl-isobutylamine, n-butyl-sec-butylamine, n-butyl-tert-butylamine, diisobutylamine, isobutyl-sec-butylamine, isobutyl-tert-butylamine, di-sec-butylamine, sec-butyl-tert-butylamine, and di-tert-butylamine.

When the emulsion can be satisfactorily stabilized due to the neutralization, there is no particular need to use a dispersion stabilizing aid. However, for better emulsion stability, a dispersion stabilizing aid is preferably used together.

Examples of the dispersion stabilizing aid include an anionic surfactant and a nonionic surfactant.

Examples of the anionic surfactant include alkyl benzenesulfonic acids and salts thereof such as sodium dodecylbenzenesulfonate; alkylsulfuric esters and salts thereof such as sodium lauryl sulfate; polyoxyalkylene alkyl ether sulfates and salts thereof such as sodium polyoxyethylene lauryl ether sulfate; polyoxyalkylene alkylphenyl ether sulfate esters and salts thereof such as sodium polyoxyethylene nonylphenyl ether sulfate; and aromatic sulfonic acid-formalin condensates and salts thereof such as sodium salts of naphthalene-sulfonic acid-formalin condensate.

Examples of the nonionic surfactant include polyoxyalkylene alkyl ether and polyoxyalkylene alkylphenyl ether. Examples of the polyoxyalkylene alkyl ether include polyoxyethylene lauryl ether, polyoxyethylene tridecyl ether, polyoxyethylene stearyl ether, and polyoxyethylene oleyl ether. Examples of the polyoxyalkylene alkylphenyl ether include polyoxyethylene nonylphenyl ether.

For preparation of the aqueous medium, for example, an amine solvent and a dispersion stabilizing aid are mixed in water so that the amount of the amine solvent is in the range of 0.01 to 10 parts by weight, or preferably 0.1 to 5 parts by weight, and the dispersion stabilizing aid is in the range of 0.01 to 10 parts by weight, or preferably 0.05 to 1 part by weight, per 100 parts by weight of water.

By doing so, the stability of emulsion and suspension can be improved in the subsequent steps (i.e., the step of preparing an emulsion, the step of preparing a suspension, and the step of preparing a toner base particle).

If necessary, an ester organic solvent is mixed in the aqueous medium. By doing so, water and the ester organic solvent are mixed in the oil medium and the aqueous medium, respectively, so that an abrupt phase change can be further suppressed in the step of preparing an emulsion.

No particular limitation is imposed on the ester organic solvent mixed in the aqueous medium, and for example, the ester organic solvent exemplified in the preparation of the oil medium as described above is used.

The ester organic solvent is mixed with water so that the amount of the ester organic solvent is in the range of 0.1 to 30 parts by weight, or preferably 0.5 to 20 parts by weight, per 100 parts by weight of water.

(Preparation of Emulsion)

For preparation of the emulsion, the aqueous medium and the resin liquid are mixed, for example, so that the amount of the resin liquid is in the range of 50 to 150 parts by weight, or preferably 60 to 120 parts by weight, per 100 parts by weight of the aqueous medium.

When the resin liquid contains a wax, the resin liquid and the aqueous medium are heated at a temperature in the range of a temperature capable of dissolving the wax or more and less than the boiling point of the ester organic solvent, for example, 30 to 70° C., or preferably 40 to 60° C., and then mixed together while the heating temperature is maintained. When a wax which does not dissolve in the solvent is formed into fine particles and added by mixing, the resin liquid and the aqueous medium are not necessarily heated and may be mixed at room temperature.

Thereafter, the aqueous medium mixed with the resin liquid is agitated while the liquid temperature is controlled as required. The agitation is performed using turbine blades (e.g., 6 flat turbine blades) or propeller blades in an agitator such as a three-one motor. In the case of using turbine blades, the agitation is performed at a tip circumferential speed of 0.5 to 3.0 m/s, or preferably 1.0 to 2.0 m/s for 10 to 120 minutes, or preferably for 15 to 60 minutes. Then, the resin liquid is formed into liquid droplets having an average diameter of 5 to 12 μm to be emulsified in the aqueous medium, so that an emulsion is prepared. In order to make an emulsion droplet smaller, a high-speed dispersing apparatus such as a homogenizer is used. Other dispersing apparatuses such as a high-pressure homogenizer can also be used. In the case of using a rotor-stator type agitator such as a homogenizer, agitation is performed at a tip circumferential speed of 5 to 20 m/s, or preferably 7 to 14 m/s for 10 to 120 minutes, or preferably for 15 to 60 minutes. Then, the resin liquid is formed into liquid droplets having an average diameter of 0.1 to 3 μm to be emulsified in the aqueous medium, so that an emulsion is prepared. In this case, however, in order to control the size of the toner base particle, a step of aggregating and fusing the toner base particle after the preparation of the emulsion is necessary. For simplification of the production process, it is preferable to control the grain diameter of the toner base particle during the preparation of the emulsion.

In the emulsification, the resin liquid may be mixed with the aqueous medium, and vice versa. When the aqueous medium is mixed with the resin liquid, a phase inversion emulsification method can also be used. Generally, the phase inversion emulsification method requires enormous time to add the aqueous medium in small amounts to the resin liquid. According to the present invention, however, the addition rate of the aqueous medium can be increased, so that productivity can be improved.

Alternatively, an amine solvent is preliminarily mixed with the resin liquid to be neutralized, so that the resin having a polar group is neutralized. The aqueous medium may be then mixed therewith. Further, the resin liquid which has preliminarily been neutralized can also be mixed with the aqueous medium.

4) Step of Preparing a Suspension

Next, in this method, the ester organic solvent is removed from the emulsion to obtain a suspension. For removal of the ester organic solvent from the emulsion, a known method such as ventilation, heating, decompression or combination thereof is employed. For example, the emulsion is heated with stirring under inert gas atmosphere, for example, at a temperature from room temperature to 90° C., or preferably 65 to 80° C. until about 80 to 95% by weight of the early amount of the ester organic solvent is removed. Then, the ester organic solvent is removed from the aqueous medium to thereby prepare a suspension (slurry) having resin microparticles of the binder resin, in which the colorant and the wax are homogeneously dispersed, dispersed in the aqueous medium.

In the resulting suspension, the solid content in the suspension (concentration of the resin microparticles in the suspension) is in the range of, for example, 5 to 40% by weight, or preferably 10 to 30% by weight. The resin microparticles dispersed in the aqueous medium have an average particle diameter by volume of, for example, 5 to 12 μm, or preferably 6 to 10 μm, as a median size.

5) Step of Preparing a Toner Base Particle

Thereafter, the resulting suspension is reverse-neutralized with an acid, filtered, and dried to obtain powders of toner base particles.

In the reverse-neutralization, for example, an inorganic acid such as hydrochloric acid, sulfuric acid or nitric acid is used to prepare, for example, a 0.01 to 5N (normal) aqueous solution, or preferably 0.1 to 2 N (normal) aqueous solution, and the resulting solution is added to the suspension so that the amount of the solution is in the range of, for example, 0.05 to 2 parts by weight, or preferably 0.1 to 1 part by weight, per 100 parts by weight of the suspension. Then, the mixture is agitated for 10 to 120 minutes, or preferably for 20 to 60 minutes, and solid-liquid separation is performed by filtering or centrifugal separation. Further, the resulting product is preferably washed with pure water several times. Subsequently, the toner base particles thus obtained are dried by a known method.

6) Mixing of an Additive

An external additive or the like is added as required to the toner base particle thus obtained to thereby obtain a desired toner.

(Addition of External Additive(s))

The external additive is added in order to adjust charging characteristics, flowability, storage stability, etc., of the toner, and is in the form of ultra-microparticles considerably smaller than the toner base particles.

Examples of the external additive include inorganic particles and synthetic resin particles.

Examples of the inorganic particle include silica, aluminum oxide, titanium oxide, silicon aluminum oxide, silicon titanium oxide and hydrophobicized products thereof. For example, a hydrophobicized product of silica can be obtained under hydrophobicizing treatment of silica micropowders using silicone oil or a silane coupling agent (e.g., dichlorodimethylsilane, hexamethyldisilazane, tetramethyldisilazane, etc.).

Examples of the synthetic resin particles include methacrylate ester polymer particles, acrylic ester polymer particles, styrene-methacrylate ester copolymer particles, styrene-acrylate ester copolymer particles, and core-shell particles (core: styrene polymer, shell: methacrylate ester polymer).

For addition of the external additive(s), for example, the toner base particles and the external additive(s) are mixed with stirring using a high-speed agitator such as a Henschel mixer and a mechanomill. The external additive is added to the toner base particles so that the amount of the external additive is in the range of, for example, 0.1 to 6 parts by weight per 100 parts by weight of the toner base particles.

7) Toner

The toner obtained by the above method is a positively-chargeable or a negatively-chargeable, non-magnetic single-component toner, and has an average particle diameter by volume of, for example, 3 to 12 μm, or preferably 6 to 10 μm, as a median size.

According to the above method, the oil medium is prepared by mixing water with an ester organic solvent at a specific ratio, so that, in the step of preparing an emulsion, even if the resin liquid is mixed with the aqueous medium, an abrupt phase change can be suppressed. This can therefore prevent poor dispersion of the colorant due to the abrupt phase change, or precipitation of the resin and the wax dissolved in the resin liquid. Thus, a toner with the colorant homogeneously dispersed can be obtained, thereby achieving improvement of the toner characteristics such as improvement in image density.

Since the amine solvent and the dispersion stabilizing aid are mixed in the aqueous medium and there is no need to use an inorganic dispersing agent, a spherical-shaped toner with a smooth surface can be produced.

EXAMPLES

The above method for producing a toner will now be more particularly described by reference to the following Examples and Comparative Examples. In the following description, the units "part(s)" and "%" are by weight, unless otherwise noted.

Examples 1 and 2

(Preparation of Colorant Dispersion)

15 parts by weight of polyester resin FC1565 (Tg (glass transition point): 64° C.; Mn (number-average molecular weight): 5000; Mw (weight-average molecular weight): 98000; crosslinked fraction (THF insoluble fraction): 1.5% by weight; acid value: 6.1 mg KOH/g; manufactured by Mitsubishi Rayon Co., Ltd.), 15 parts by weight of carbon black #260 (manufactured by Mitsubishi Chemical Corporation), and 70 parts by weight of ethyl acetate were mixed, and the mixture was preliminarily dispersed with a homogenizer DIAX 900 (manufactured by Heidolph Instruments).

Next, the dispersed mixture was finely dispersed with a beads mill (using ϕ 0.8 mm zirconia beads) to prepare a colorant dispersion. The colorant dispersion was found to have a solid content of 30% by weight.

(Preparation of Oil Medium)

Separately, ethyl acetate and pure water were mixed in the amounts shown in Table 1 to prepare an oil medium. The number of parts by weight of water (water portion) per 100 parts by weight of ethyl acetate and the water content of the oil medium are collectively shown in Table 1.

(Preparation of Resin Liquid)

The entire amount of the oil medium was slowly supplied into 60 g of the colorant dispersion to an extent that the carbon black was not aggregated, and then mixed.

Subsequently, 162 g of a polyester resin (FC1565), 9 g of a wax (ester wax: UNISTER H476; manufactured by NOF Corporation) and 9 g of a charge-controlling agent (nigrosine dye: BONTRON N-04; manufactured by Orient Chemical Co., Ltd.) were supplied into the mixed solution, and the mixture was agitated with a homogenizer at an agitation speed of 15000 rpm for 10 minutes to prepare a resin liquid.

(Preparation of Aqueous Medium)

Separately, 8.1 g of propylamine (manufactured by KANTO CHEMICAL CO., INC.) and 1.8 g of sodium dodecylbenzenesulfonate (NEOGEN S-20A: manufactured by Dai-Ichi Kogyo Seiyaku Co., Ltd.) were mixed with pure water to prepare an aqueous medium.

The amount of the pure water was adjusted so as to make up a total amount of 1200 g including the amount of pure water in the resin liquid.

(Preparation of Emulsion)

The entire amount of the resin liquid and the entire amount of the aqueous medium each were heated to 50° C. and then mixed together in a 2-L beaker.

Thereafter, the mixture was agitated with a three-one motor (6 flat turbine blades) at 400 rpm for 20 minutes to prepare an emulsion.

(Preparation of Suspension)

The emulsion thus prepared was transferred to a 2-L separable flask and then heated to 70° C. with agitation (specifically, with a three-one motor having turbine blades at 200 rpm). Air was then blown thereonto to volatilize and remove ethyl acetate, so that a suspension having resin microparticles dispersed in water was obtained.

(Preparation of Toner Base Particle)

After the suspension thus obtained was filtered to collect solid particles, the solid particles were again suspended in water and 4 g of a 1 N aqueous hydrochloric acid solution was added to the suspension to be reverse-neutralized. Thereafter, the suspension was filtered, washed with pure water several times, and then dried, so that toner base particles were obtained.

The observation under a scanning electron microscope confirmed that the toner base particles thus obtained were spherical-shaped particles with smooth surfaces.

(Addition of Additive)

An amount 1.5 parts by weight of a silica (HVK2150: manufactured by Clariant) was added to 100 parts by weight of the toner base particles thus obtained, and the mixture was mixed with stirring using a MECHANOMILL (manufactured by OKADA SEIKO CO., LTD.) at 2500 rpm for 5 minutes, whereby a non-magnetic single-component positively chargeable toner was obtained.

Example 3

The same procedures as in Example 1 were performed except that each amount of the ester organic solvent and the pure water was as shown in Table 1, and pure water and ethyl acetate were mixed in the steps of preparing an oil medium and an aqueous medium, to thereby produce a toner.

The observation under a scanning electron microscope confirmed that the toner base particles obtained were spherical-shaped particles with smooth surfaces.

Comparative Examples 1 and 2

The same procedures as in Example 1 were performed except that each amount of the ethyl acetyl and the water was as shown in Table 1 in the step of preparing an oil medium, to thereby produce a toner.

[Table 1]

TABLE 1

| | Oil Medium | | | | Aqueous Medium | | |
|---|---|---|---|---|---|---|---|
| | Ethyl Acetate (g) | Pure Water (g) | Water Content (wt. %) | Water Portion (p/wt) | Pure Water (g) | Organic Solvent (g) | Content of Ethyl Acetate (wt. %) |
| Ex. 1 | 558 | 17 | 3.0 | 3.0 | 1183 | 0 | 0 |
| Ex. 2 | 558 | 5.5 | 1.0 | 1.0 | 1194.5 | 0 | 0 |
| Ex. 3 | 540.3 | 8.3 | 1.5 | 1.5 | 1191.7 | 17.7 | 1.46 |
| Comp. Ex. 1 | 558 | 4.5 | 0.8 | 0.8 | 1195.5 | 0 | 0 |
| Comp. Ex. 2 | 558 | 0 | 0 | 0 | 1200 | 0 | 0 |

Evaluation of Toner (Particle Size Distribution)

With respect to the obtained toner, values of the average particle diameter by number Dn, the average particle diameter by volume Dv, and Dv/Dn serving as an index of uniformity in particle size are shown in Table 2. The particle size distribution of the toner was measured using a Coulter Multisizer II (manufactured by Beckman Coulter, Inc.). The analyzer with an aperture diameter of 100 μm was used. About 0.2 g of the obtained toner and 20 ml of an aqueous solution containing a 0.01% by weight surfactant (PELEX OT-P; manufactured by Kao Corporation) were mixed and then dispersed with an ultrasonic cleaner to prepare a dispersion. About three drops of the resulting dispersion were supplied into the analyzer by a 2-ml dropping pipet to measure the particle size distribution of about 50000 particles, and the median size thereof was determined as the average particle size.

[Table 2]

TABLE 2

| | Dn (μm) | Dv (μm) | Dv/Dn |
|---|---|---|---|
| Ex. 1 | 7.2 | 9 | 1.25 |
| Ex. 2 | 7.2 | 9.1 | 1.26 |
| Ex. 3 | 7.3 | 9.2 | 1.26 |
| Comp. Ex. 1 | 6.9 | 9.1 | 1.32 |
| Comp. Ex. 2 | 6.8 | 9.2 | 1.35 |

(Coloring State of Toner)

The blackness of the obtained toner itself was evaluated as an index of pigment dispersibility in the toner particle.

Specifically, 2 g of the toner base particles before addition of an additive were sampled, the sampled toner base particles were charged into a compression pressing machine (BRIQETTING PRESS BRE-30; manufactured by MAEKAWA MACHINE MFG), and then compressed at 60 kN for 2 minutes to obtain a (circular) pellet having a diameter of 40 mm.

The reflection density of the obtained pellet was measured using a reflective densitometer (TR914; manufactured by Macbeth Process Measurements Co.). A total of 9 points including 1 point at a center of the pellet and 8 points near the periphery thereof were measured and then averaged. The average result was determined as an index of pigment dispersibility. When the average value was 1.60 or more, it was judged that the toner base particles appeared visibly black. The results are shown in Table 3.

[Table 3]

TABLE 3

| | Water Content (wt. %) | Blackness of Toner (Reflection Density) |
|---|---|---|
| Ex. 1 | 3.0 | 1.60 |
| Ex. 2 | 1.0 | 1.59 |
| Ex. 3 | 1.5 | 1.61 |
| Comp. Ex. 1 | 0.8 | 1.41 |
| Comp. Ex. 2 | 0 | 1.40 |

(Printing Density of Toner)

The toner obtained in each of Examples and Comparative Examples was charged into a developer cartridge of a printer (HL-1850; printing speed: 18 ppm; manufactured by Brother Industries, Ltd.), three sheets of print samples of which a square solid portion (solid patch) was printed on the four corners were printed out, and the printing density of each of the solid patches was measured.

Each solid patch has a size of 25 mm per side, and Xerox 4200 (A4 size) paper was used. A reflective densitometer (TR914; manufactured by Macbeth Process Measurements Co.) and a transmission densitometer (TD904; manufactured by Macbeth Process Measurements Co.) were used to measure the printing density, and the reflection density and the transmission density were measured as the printing density. Further, the image quality was visually judged. The criteria of judgment for the image quality are shown below.

The printing density was measured at five points (four corners and a center) per solid patch, and the average of those points on the three sheets of print samples was adopted as a representative value of the printing density. Only the solid patch on the upper left corner was measured to determine the printing density. The results are shown in Table 4.

[Table 4]

TABLE 4

| | Water | Printing Density | | | |
|---|---|---|---|---|---|
| | Content (wt. %) | Reflection Density | Transmission Density | Image Quality | Amount of Toner (mg) |
| Ex. 1 | 3.0 | 1.46 | 1.93 | B | 3.6 |
| Ex. 2 | 1.0 | 1.45 | 1.92 | B | 3.7 |
| Ex. 3 | 1.5 | 1.47 | 1.95 | A | 3.6 |

TABLE 4-continued

| | Water | Printing Density | | | |
|---|---|---|---|---|---|
| | Content (wt. %) | Reflection Density | Transmission Density | Image Quality | Amount of Toner (mg) |
| Comp. Ex. 1 | 0.8 | 1.32 | 1.83 | C | 3.7 |
| Comp. Ex. 2 | 0 | 1.31 | 1.83 | C | 3.6 |

Image Quality:

A: Generation of fog was not observed by visual inspection, and no density unevenness exists on the solid patch.
B: Generation of fog was scarcely observed by visual inspection, or density unevenness exists on a fraction of the solid patch.
C: Generation of fog was slightly observed by visual inspection, or, density unevenness exists on the entire solid patch.

When comparisons are made to evaluate the printing density of the toner, the amount of the toner developed on the sheet should be constant. Since a commercially available printer was used for such evaluation, whether or not the printing density thereof was compared with the same amount of toner needs to be checked.

The following test was conducted to check the amount.

Specifically, the fixing assembly was removed from the printer and an unfixed print sample was collected. A solid patch (only a solid patch on the upper left corner) on the unfixed print sample was cut out with scissors or the like, and the weight of the cut piece was measured with a precision electric balance. Thereafter, unfixed toners on the cut sheet piece were blown off by air. The weight of the sheet piece after the unfixed toners were removed was measured, and the weight of a developed toner was calculated by subtracting the weight of the sheet piece of the unfixed print sample after the removal of the toners from the weight of the cut piece with the solid patch thereof.

Similarly, the weight of the developed toner on each of the three sheets of printed samples was measured. The results confirmed that, as for all the toners obtained in Examples 1 to 3 and Comparative Examples 1 and 2, the developed toner had a weight in the range of 3.6 to 3.7 mg, so that almost the same amount of toner was used to compare the printing density.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. A method for producing a toner comprising the steps of:

preparing a resin liquid by mixing at least a binder resin made of polyester resin and a colorant with an ester organic solvent represented by the following general formula (1);

dispersing the resin liquid in an aqueous medium to form an emulsion; and removing the ester organic solvent from the emulsion to produce a toner, wherein the ester organic solvent before the preparation of the resin liquid contains water in an amount of not less than 1% by weight and up to the saturation solubility at 25° C. to the ester organic solvent:

[Chem. 1]

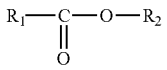

(1)

(wherein R1 is a hydrogen atom or a methyl group, and R2 is an alkyl group having 1 to 4 carbon atoms).

2. The method for producing a toner according to claim 1, wherein the aqueous medium comprises an amine solvent.

3. The method for producing a toner according to claim 1, wherein the aqueous medium comprises the ester organic solvent.

4. The method for producing a toner according to claim 1, wherein the aqueous medium comprises a dispersion stabilizing aid.

5. The method for producing a toner according to claim 1, wherein the amine solvent is a primary alkyl amine having an alkyl group of 2 to 4 carbon atoms.

* * * * *